United States Patent [19]

Groves et al.

[11] Patent Number: 4,798,287

[45] Date of Patent: Jan. 17, 1989

[54] SYSTEM FOR INTRODUCING FLOWABLE ADDITIVE INTO A CLOSED CONTAINER

[75] Inventors: Michael H. Groves; Digby R. Redshaw, both of Warwick; Michael R. Cane, Stockton, all of England

[73] Assignee: Imperial Chemical Industries plc, London, England

[21] Appl. No.: 61,423

[22] Filed: Jun. 12, 1987

[30] Foreign Application Priority Data

Feb. 12, 1987 [GB] United Kingdom ..... 8703205

[51] Int. Cl.[4] ..... B65D 25/08

[52] U.S. Cl. ..... 206/219; 366/605; 215/258; 215/DIG. 8

[58] Field of Search ..... 366/150, 605; 206/219, 206/221; 220/265; 215/250, 258, DIG. 8

[56] References Cited

U.S. PATENT DOCUMENTS

| | | | |
|---|---|---|---|
| 2,524,366 | 10/1950 | Smith | 206/221 |
| 2,524,607 | 10/1950 | Smith | 206/221 |
| 2,528,530 | 11/1950 | Machleder | 366/605 X |
| 2,819,738 | 1/1958 | Marberg | 366/605 X |
| 3,347,410 | 10/1967 | Schwartzman | 206/222 X |
| 3,439,823 | 4/1969 | Morane | 206/221 |
| 3,521,745 | 7/1970 | Schwartzmann . | |
| 3,720,523 | 3/1973 | Nakagami . | |
| 4,386,696 | 6/1983 | Goncalves | 215/258 X |
| 4,727,985 | 3/1988 | McNeirney et al. | 215/DIG. 8 |

FOREIGN PATENT DOCUMENTS

| | | | |
|---|---|---|---|
| 0014805 | 9/1980 | European Pat. Off. . | |
| 2441406 | 3/1975 | Fed. Rep. of Germany | 215/DIG. 8 |
| 2153767 | 5/1973 | France . | |
| 2453793 | 11/1980 | France . | |
| 1107863 | 8/1984 | U.S.S.R. | 206/219 |
| 303806 | 2/1930 | United Kingdom . | |
| 1131193 | 10/1968 | United Kingdom . | |
| 1211168 | 11/1970 | United Kingdom | 215/250 |
| 2021513 | 12/1979 | United Kingdom | 206/219 |

*Primary Examiner*—William Price

*Attorney, Agent, or Firm*—Cushman, Darby & Cushman

[57] ABSTRACT

A system for introducing additive (3) from a capsule (1) into a closed (preferably lidded) container (2) (for example a paint container) modified by the provision of a relatively easily openable inlet (9) into the container (2). Preferably the inlet (9) is located in a lid (6). Capsule (1) comprises a chamber (23) which contains the additive (3). The system is provided with means (25 and 34) for creating an opening in chamber (23) which can communicate with inlet (9) and means (preferably a compressibe chamber (23)) for expelling additive 3 through the opening. Capsule (1) and container (2) are also provided with co-operable locating means (10 and 24) which can co-operate to assist in locating the opening created in chamber (23) in communication with inlet 9. Also a capsule (1), a closed container (2) for use in the system and a method of introducing additive (3) using the system. Use of the system reduces the risk of spillage and splasing and is more suitable for use by inexperienced people.

19 Claims, 10 Drawing Sheets

SYSTEM FOR INTRODUCING FLOWABLE ADDITIVE INTO A CLOSED CONTAINER

Figure 1:
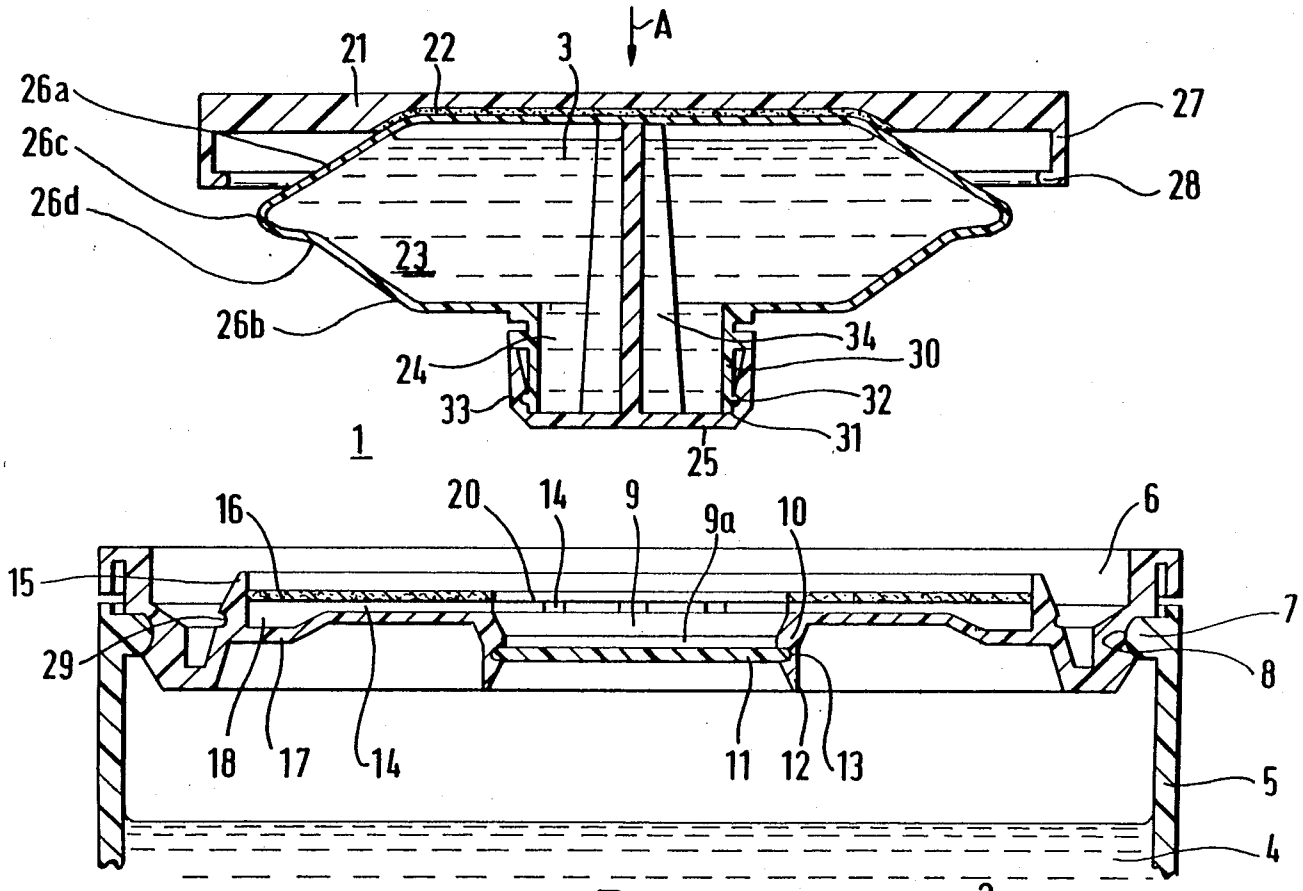

This invention relates to a system for introducing flowable additive from a capsule into a closed (preferably lidded) container. The additive may be any material which can be caused to flow well enough to enable it to be expelled from the capsule. The invention especially relates to a system for introducing (usually liquid or semi-solid) colourants into base paint contained in a lidded paint can. Such introduction of colourants is often known as "tinting". Other additives which can be introduced into base paints using the system include fungicides, foaming agents, rheology modifiers, components (usually a catalyst or accelerator) of a multi-component paint or additives which modify the appearance of the paint such as flowable particulate solids including metal flakes provided they can be made to flow.

Hitherto base paint in lidded cans (especially when on sale in retail shops) has usually been tinted by removing the lid from the can (or even punching a hole in the lid), introducing the correct amount of colourant into the can, replacing the lid (or plugging the hole) and finally shaking the can in a mechanical shaker to disperse the colourant. Removal of the lid creates an opportunity for the paint to be spilled or splashed and so this type of tinting technique is generally inconvenient and particularly not very suitable for use by inexperienced people, especially members of the public in self-service shops. Punching a hole in the lid requires the skilled use of a sharp tool and so it is a technique which is quite unsuitable for use by inexperienced people. A further difficulty is that care is needed to ensure that the correct amount of additive is introduced into the container. The amount of care needed can be reduced by supplying measured amounts of additive in capsules but even then some care is still needed to ensure that the capsule is properly emptied. One object of this invention is to provide a system for introducing additive from a capsule into a container which involves less risk of spillage and splashing whilst an object of a refinement of the invention is to provide a system especially suitable for use by inexperienced members of the public. An object of a further refinement is to minimise the care needed to ensure that the capsule is properly emptied. Another object of the invention is to provide a system which allows a container into which additive has been introduced to be safely shaken in a mechanical shaker.

Accordingly this invention provides a system for introducing flowable additive from a capsule into a closed (preferably lidded) container wherein the system comprises (a) a closed container provided with an inlet into the container which inlet is closed by a closure but which inlet is openable by a force exerted on the closure provided that if the container comprises a lid, the minimum force needed to open the inlet shall be insufficient to open the container by moving the lid, (b) a capsule which comprises a chamber containing additive, (c) means carried by the container or preferably by the capsule for use in creating an opening in the chamber which opening can communicate with the inlet into the container and (d) means for use in expelling additive from the chamber through the opening, and wherein the container and capsule are provided with co-operable locating means which can at least assist in locating the opening created in the chamber in communication with the inlet into the container. The use in combination of an inlet (ie the "container inlet") which is specifically designed to be openable to communicate with an opening created in a capsule chamber containing additive together with a locating means which assists in locating the opening created in the chamber in communication with the container inlet substantially reduces the opportunities for spillage and splashing. This invention also provides a combination comprising the closed container, the capsule, the means for use in creating an opening and the means for use in expelling additive as defined above wherein the locating means co-operate to locate an opening created in the chamber of the capsule in communication with the container inlet. Preferably the means for creating an opening in the chamber (ie the "opening means") is actuated by the exertion of a (preferably external) force on the capsule acting in a direction which is inwards of the container. Also the opening means should preferably be operative only during and/or after the opening of the container inlet because this further reduces the opportunities for spillage from the capsule chamber and therefore makes the system especially suitable for use by inexperienced members of the public.

The means for expelling additive from the chamber (ie the "expulsion means") may comprise gas under positive pressure within the chamber. However, the use of positive pressure has the disadvantage of requiring a very strong and therefore expensive chamber. Gas under positive pressure may also atomise a liquid additive so increasing the risk of additive escaping should the capsule be incompetently located on the container.

Preferably the expulsion means is actuated by the exertion of a force on the exterior of the capsule. In an especially preferred system, the expulsion means comprises a chamber which is compressible preferably in response to a force exerted on a portion of the capsule which is remote from the container so that the expulsion means can be actuated by compressing the chamber in a direction which is inwards of the container. It is also preferred that the force which compresses the chamber, the force which operates the opening means and the force which opens the inlet, should all act inwards of the container and along the same line because then the forces needed to operate the system can be conveniently supplied by opposed jaws of a mechanical shaker. If the closed container is lidded, it is preferred that the inlet should be formed in the lid and should be openable by a force acting inwards of the container because then the force which opens the inlet will act in a direction which urges the lid inwards of the container and so does not loosen or remove the lid from the container.

The co-operating locating means provided on the container and capsule preferably comprise a recess which can receive a projection. Preferably the recess should be formed in the closed container and the projection should extend from the capsule. An especially preferred system comprises a recess formed in the container which recess leads to the inlet closure and a projection on the capsule which comprises an outlet through which additive can be expelled from the capsule because then receipt of the projection into the recess further reduces the opportunities for spillage and splashing and may also give a more positive location of the chamber opening in communication with the inlet. Preferably when the projection is centrally located within the recess, the maximum clearance between the projection and the recess should not exceed 4 mm. The inlet may comprise for example a skirt (ie the "inlet skirt") which extends into the container and which is closed by a closure located at the distal end of the skirt so as to define a blind recess which can receive a projection on the capsule. Preferably the projection on the capsule comprises a preformed outlet closed (preferably at its distal end) by a displaceable closure which can be displaced to create the opening in the chamber.

The container inlet can be closed by a closure (for example a screw-cap or an adhesive tab) which requires a force exerted in a direction outwards of the container in order to remove the closure and open the inlet. However (unless complex removal means are employed) such closures have the serious disadvantage that they need to be removed before the capsule can be located on the container and this, of course, creates a momentary opportunity for spillage. Moreover, if the container inlet is formed in a lid, the exertion of an excessive outwards force on the inlet closure may loosen or even remove the lid. Therefore it is preferred to use an inlet closure which is openable by a force exerted in a direction inwards of the container. Such a closure may be integral with the inlet. However the opening of an inlet closed by an integral closure would require a rupturing action, for example a rupturing or puncturing action imparted by a spike or needle carried on the capsule. Rupturing actions can be unpredictable and so it is preferred to have a closure which is formed separately from the inlet and which is then engaged on the inlet by means which disengage in a more predeterminable way. The inlet can then be opened by disengaging and displacing the closure. Examples of such more predeterminable engagement means include a frangible layer of adhesive, a press fit or most preferably a snap-action fit.

The opening in the capsule chamber may be created by rupturing a closure or part of a wall which defines the container. Rupturing may be performed using opening means which comprise a spike possibly carried on the container but preferably sandwiched either between a wall of the chamber opposed to the closure or sandwiched between opposed walls of the chamber so that a compressing force exerted on the opposed members causes the spike to pierce either the closure or a wall. However rupturing actions can be unpredictable, so it is preferred to provide the chamber with a preformed outlet closed by a closure (ie the "outlet closure") formed separately from the chamber and engaged on the outlet by means which can be disengaged in a relatively predeterminable way, for example those types used to engage the inlet closure. The opening is then created by disengaging and displacing the closure. The opening means preferably comprises an arm carried on the outlet closure and which extends inwardly of the chamber towards (and which preferably touches) a portion of the chamber wall lying opposite the closure so that a compressing force exerted on that portion can be transmitted via the arm and exerted as a disengaging force and a displacing force on the closure. It is preferred that a preformed outlet on the chamber should comprise a skirt (ie the "outlet skirt") which is dimensioned so as to be receivable by the inlet skirt whereby the outlet skirt can serve as a locating projection. Preferably the outlet skirt is long enough to penetrate far enough into the closed inlet to enable a force exerted on the capsule to be transmitted via the skirt and exerted on the inlet closure in order to open the inlet. Alternatively, the distal end of the dependent outlet skirt may be provided with a displaceable closure of the type which carries an arm so that a force which opens the container inlet can be transmitted from the capsule via the arm to the inlet closure. The distal end of the arm may be provided with a stop (for example a barb) which comes up against the chamber outlet as the outlet closure is displaced and thereby prevents the arm from falling into the paint.

A capsule chamber which is compressible preferably comprises walls composed of a flexible material, for example a plastics foil. In order that the chamber be compressible in a predetermined way, it is preferred to provide at least one line of weakness and/or an angled portion of wall which extends at least part and preferably all of the way around the chamber. An angled portion may be moulded into the flexible material or it may comprise a crease or it may be made by welding. Preferably the chamber has a shape in the form of two opposed adjacent dishes joined around their perimeters. This double dish shape assists in achieving a high degree of expulsion of additive when the chamber is fully compressed. It may also be useful for the dish which is to be nearest the container to be formed with a concave curved portion adjacent its perimeter. It has been found that such a concave portion can co-operate with suitably shaped surfaces in the system to cause the double dish shape to collapse on compression of the chamber in such a way that the dishes exert a force which propels additive towards the opening in the chamber. This propelling force is especially useful when the additive comprises particles of solid which do not flow easily. It is preferred that the capsule should also comprise a relatively rigid member attached to (preferably adhesively bonded to) a portion of the chamber wall against which a force is to be exerted. The rigid member serves to distribute force over that portion of the chamber wall.

Preferably the container and the capsule are provided with co-operating sealing means which can co-operate to provide a replacement closure for the container inlet so as to prevent spillage from the container after the inlet closure has been displaced. The sealing means may for example comprise inlet and outlet skirts which are dimensioned so that one makes a sealing press fit within the other. Alternatively the skirts may comprise interengageable screw-threads which can co-operate to make a sealing screw-fit. Press and screw fits may inhibit the ability of displaced air to escape from the container, so a preferred sealing means comprises a (preferably resilient) rim which extends from the capsule and around the chamber opening and which is adapted to make a snap fit in a co-operable sealing means which extends around the inlet. Preferably the snap action is provided by a rib receivable in a groove. It is preferred that the sealing means are so positioned that they only co-operate to provide the replacement closure after the inlet has been opened and/or after expulsion of the additive into the container has terminated so as to allow the escape of any air displaced from the container. Preferably the container is provided with one or more catchment cavities arranged around and in communication with the container inlet. These cavities serve to trap material which may be splashed and carried out through the inlet by the escaping air.

Flexible plastics material used in making a compressible capsule chamber is preferably a foil of polyethylene terephthalate. Other components of the capsule and the container are preferably made from a tough thermoplastics material, especially a crystalline polyolefine such as polyethylene, polypropylene or a polypropylene modified by the presence of added rubbery material or copolymerised ethylene. To avoid accidental opening of the container inlet or the capsule chamber, it is preferred that a force greater than that which can be applied by the unaided hand (for example a force of at least 0.4 kN) be required to open the inlet or to create the opening in the chamber. Preferably the force needed should not exceed 3 kN and usually a force of 0.05 to 1.3 kN is most suitable.

Figure 2:
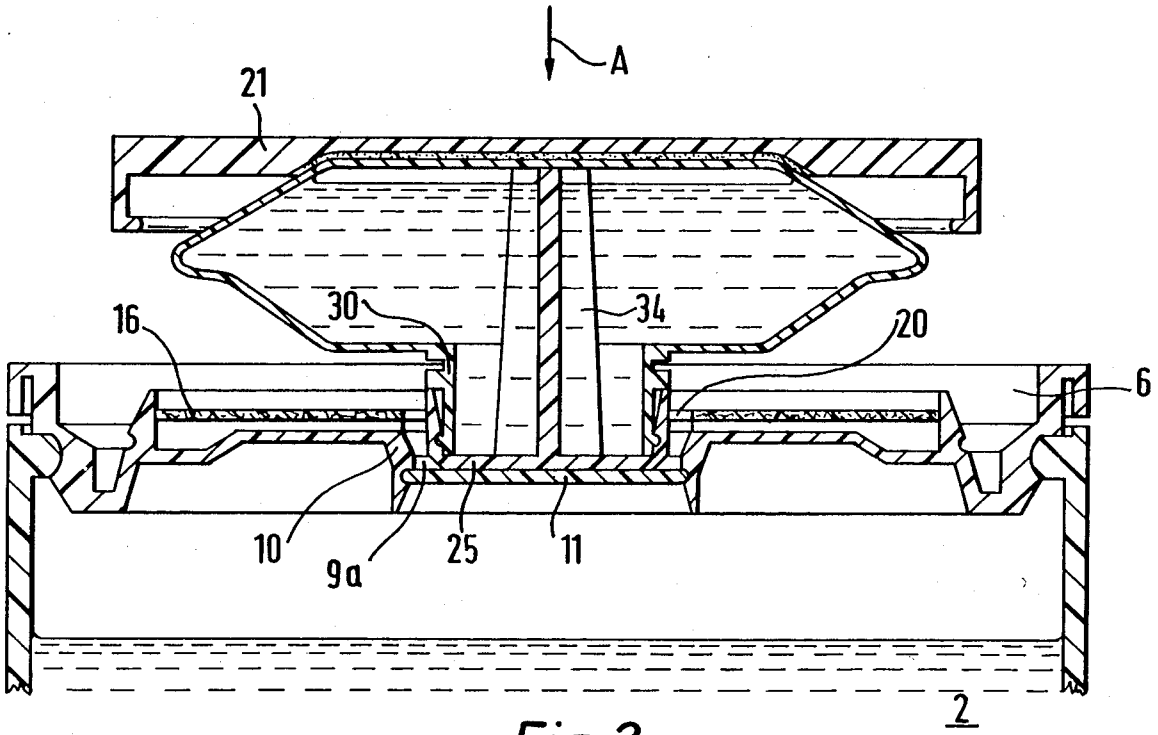
Figure 3:
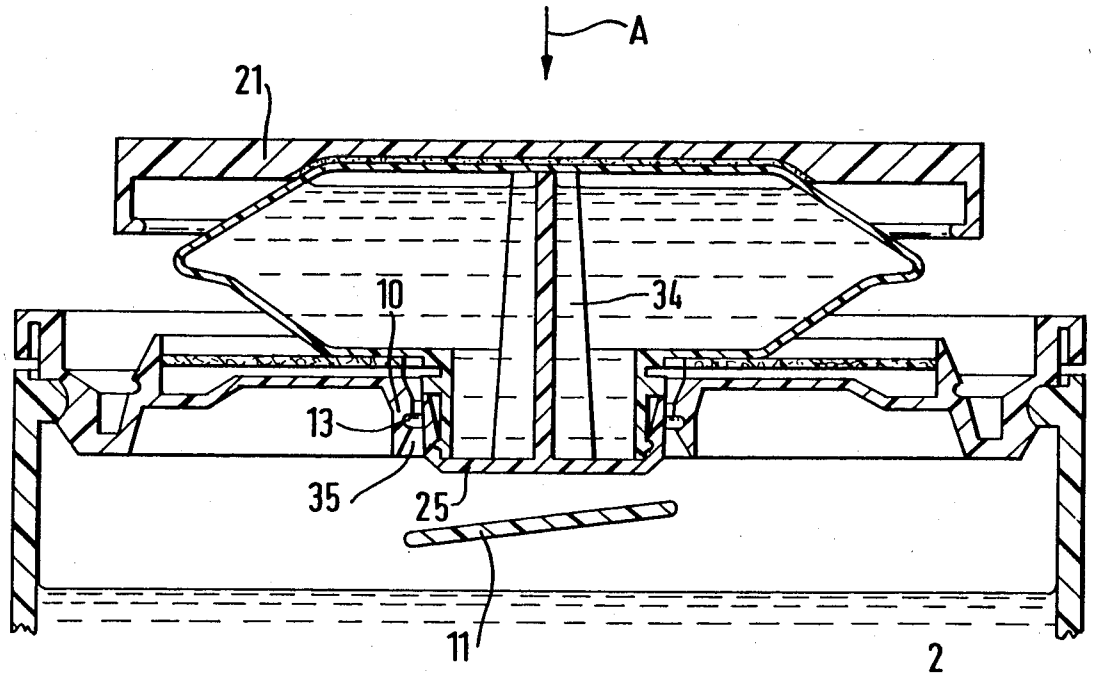
Figure 4:
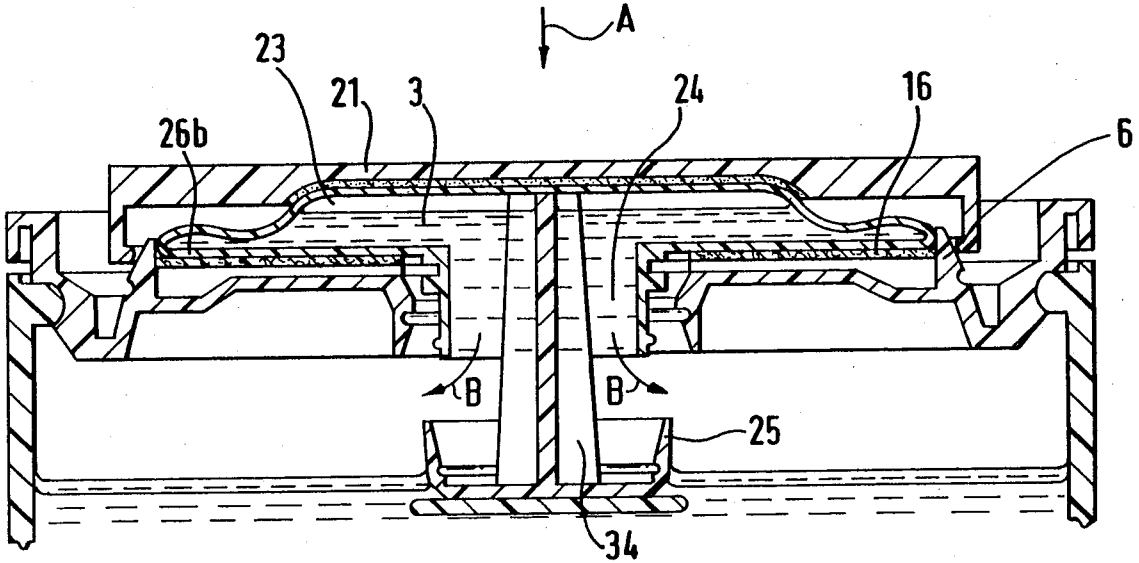
Figure 5:
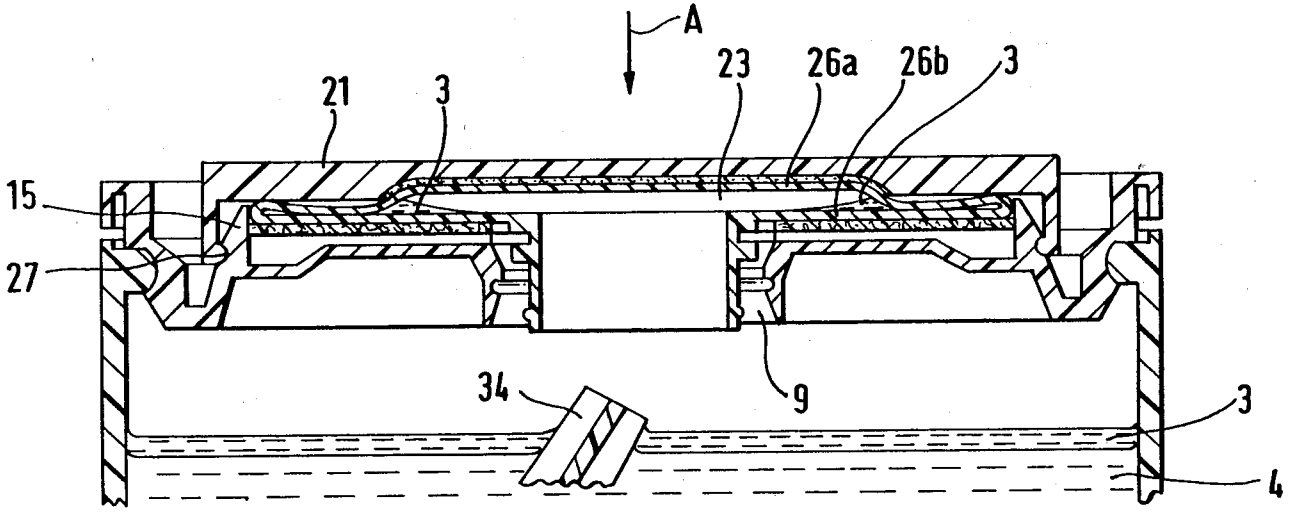

The invention is further illustrated by the following preferred embodiments which are described with reference to the drawings of which FIG. 1 is a section of a system according to this invention and shows part of a container and a capsule, FIG. 2 is a section of the container of FIG. 1 shown receiving the capsule of FIG. 1, FIG. 3 is a section of the container and of the capsule shown in FIG. 2 but after the container inlet closure has been opened, FIG. 4 is a section of the container and of the capsule shown in FIG. 3 but after the capsule chamber has been compressed, FIG. 5 is a section of the container and capsule shown in FIG. 4 but after the sealing means co-operated to provide a replacement closure for the container inlet.

Figure 6:
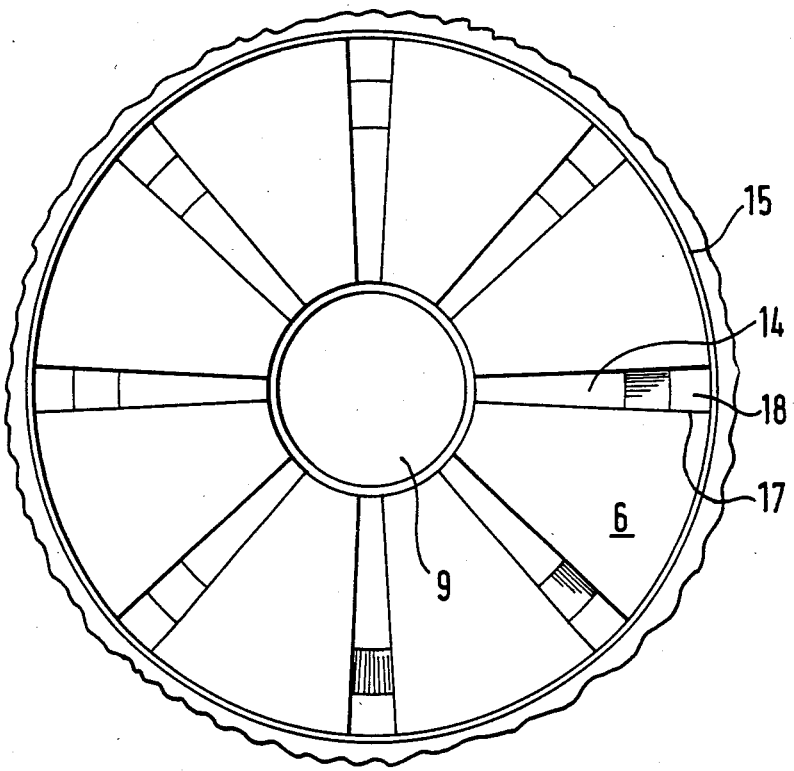

FIG. 6 is a plan of a central fragment of the lid shown in FIGS. 1 to 5 and omitting disc 16.

Figure 7:
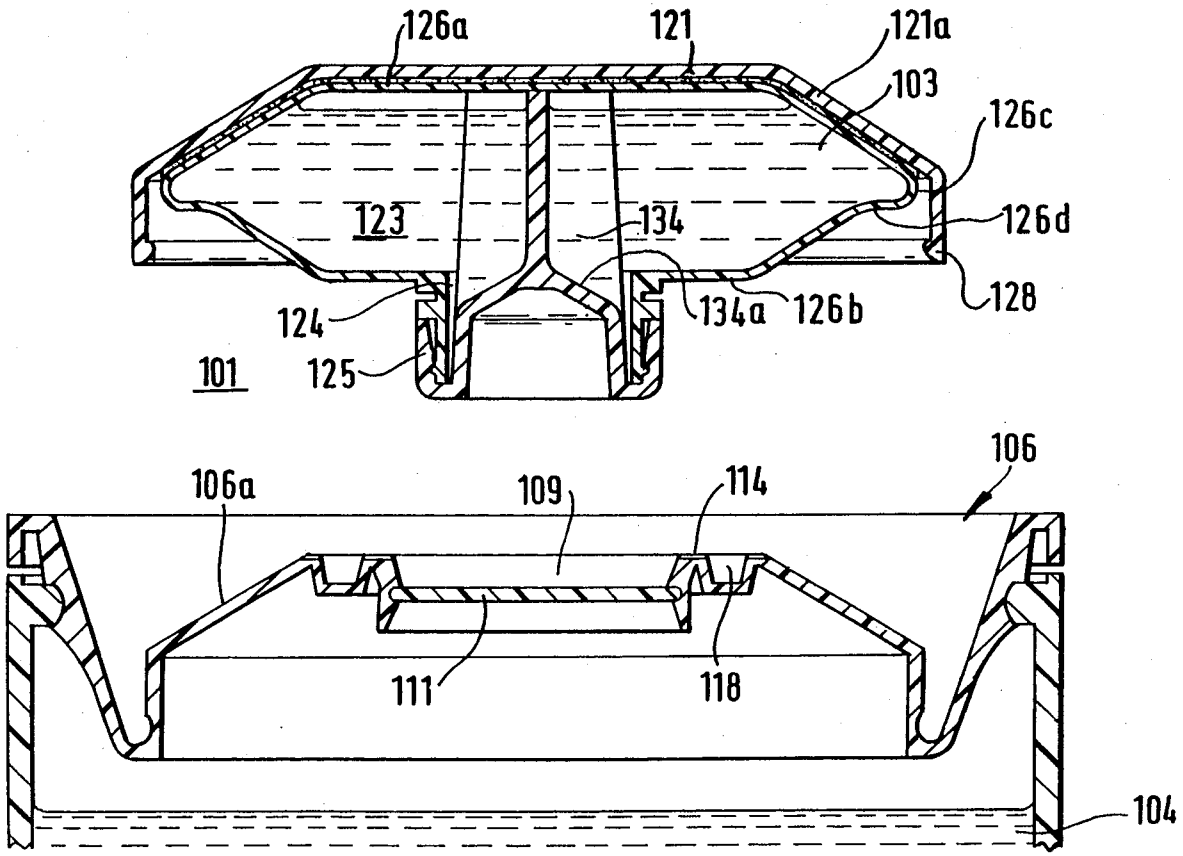
Figure 8:
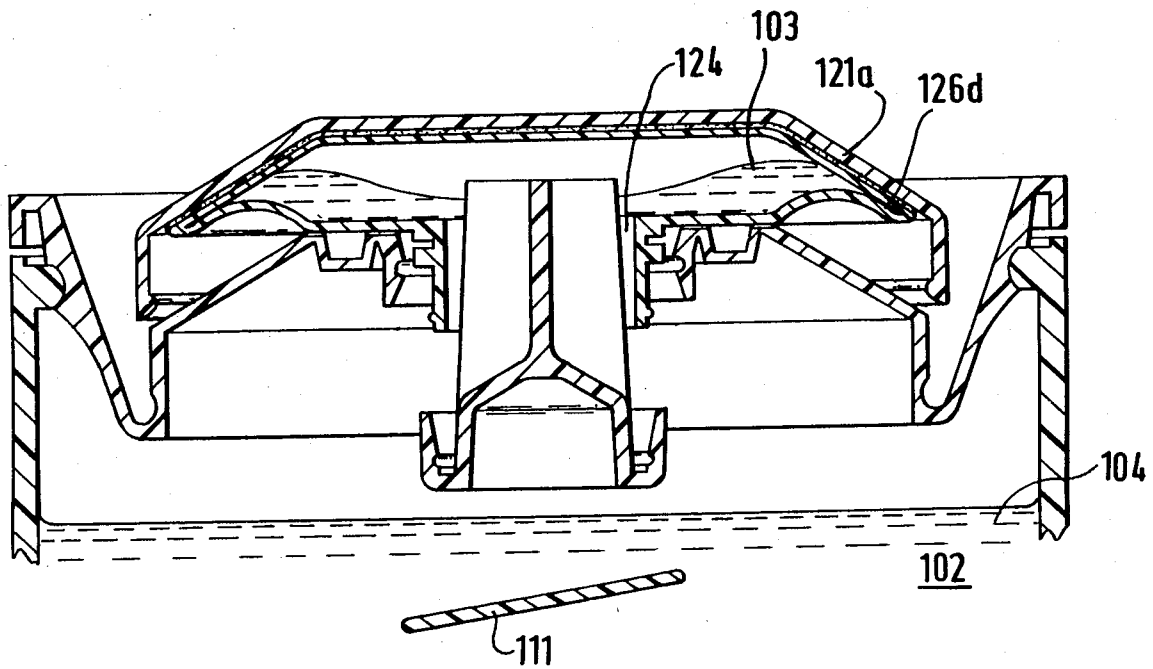
Figure 9:
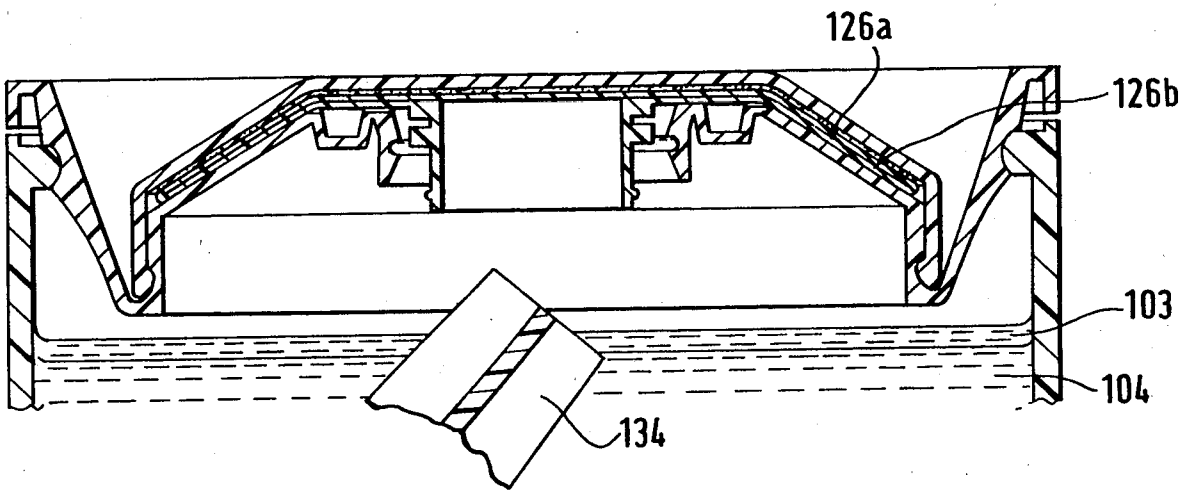
Figure 10:
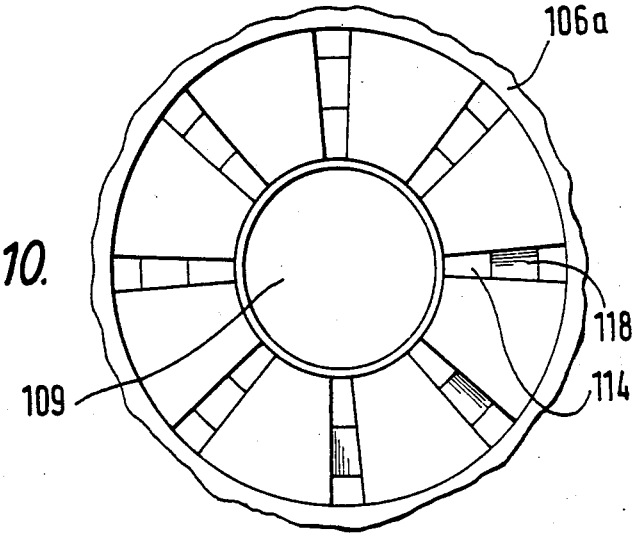
Figure 11:
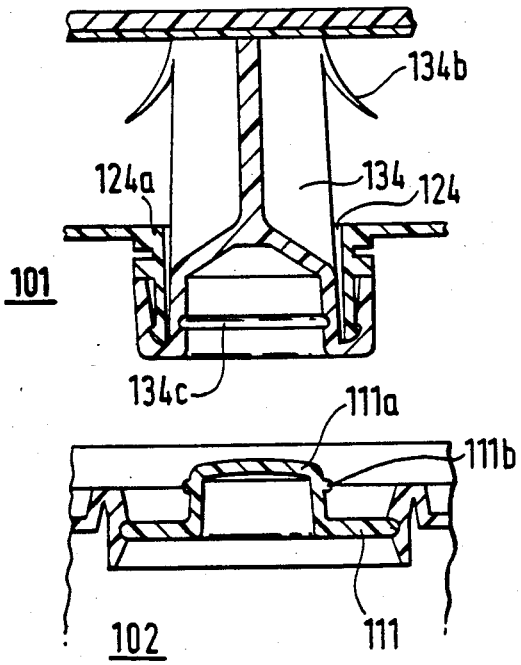
Figure 12:
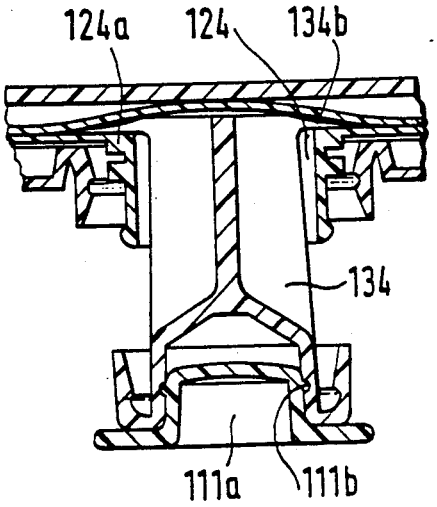

FIG. 7 is a section of an alternative system according to this invention and shows part of a container and a capsule, FIG. 8 is a section of the container of FIG. 7 shown receiving the capsule, FIG. 9 is a section of the container and capsule of FIG. 7 showing the capsule finally in place on the container, FIG. 10 is a plan of a central fragment of the lid shown in FIG. 7, FIG. 11 is a section of a central fragment of a system of the type shown in FIG. 7 but having a modified opening means and inlet closure and FIG. 12 is a section showing the fragment of FIG. 11 when the opening means is fully advanced into the container.

FIG. 1 shows a system comprising a capsule 1 and a closed container 2 which is suitable for introducing semi-solid colourant 3 from capsule 23 into paint 4 contained in container 2. Closed container 2 consists of a paint can 5 on which is engaged a plastics lid 6 by means of a fluid-tight snap fit provided by circumferential rib 7 which engages circumferential groove 8.

Lid 6 is provided with a circular closed inlet 9 having an inlet skirt 10 which extends inwardly of closed container 2 and defines a recess 9*a*. Inlet 9 is closed by a plug 11 engaged on distal end 12 of inlet skirt 10 by means of a fluid-tight snap fit into circumferential groove 13. Lid 6 is also provided with an upstanding circular flange 15 and a stiff cardboard bridging disc 16 containing hole 20. Disc 16 serves to provide a surface which can carry printed instructions for the operation of the system. Lid 6 further provides eight radial troughs 14 and associated rebates 17 equally spaced around inlet 9 (see FIG. 6) and which co-operate with bridging disc 16 to define a catchment cavity 18 which traps droplets of colourant 3 and/or paint 4 carried through inlet 9 by displaced air escaping from container 2.

Capsule 1 is composed of circular rigid plastics cover 21 bonded by layer 22 of adhesive to compressible circular chamber 23 which contains colourant 3 and which is provided with a circular chamber outlet 24 closed by a circular cap 25. Chamber 23 is defined by two opposed dished portions 26*a* and 26*b* of flexible plastics foil which join at circumferential angled portion 26*c* which helps to predetermine the way in which chamber 23 compresses. Lower dished portion 26*b* is formed with a concave curve 26*d* adjacent angled portion 26*c*. Cover 21 serves both to distribute any force applied to the top of capsule 1 over upper dished portion 26*a* of chamber 23 and to provide a mounting for resilient dependent annular rim 27. Rim 27 is adapted to provide part of a sealing means by the provision of circumferential rib 28 which can engage a co-operable circumferential groove 29 formed in flange 15 on lid 6 so as to provide a fluid-tight snap fit. Chamber outlet 24 has circular projecting dependent outlet skirt 30 whose diameter is small enough to allow outlet 24 to be received with a clearance fit into the blind recess defined by inlet skirt 10 and plug 11. The clearance (35 ) see FIG. 3, is 1 mm. Accordingly, outlet skirt 30 and inlet skirt 10 can assist in locating an opening to be created in chamber 23 in communication with inlet 9. The opening will be created by disengagement of cap 25 from outlet 24.

Cap 25 closes distal end 31 of outlet 24 by means of a fluid-tight snap fit formed by the engagement of circumferential lug 32 in circumferential recess 33. Cap 25 is formed with an integral arm 34 which extends back into chamber 23 and abuts upper dished portion 26*a* so that a compressive force exerted on upper dished portion 26*a* is transmitted downwards by arm 34.

To use the system, closed chamber outlet 24 of capsule 1 is inserted through hole 20 in disc 16 into inlet skirt 10 until cap 25 rests on plug 11 as shown in FIG. 2. Force generated outside capsule 1 is then exerted on cover 21 in a direction which (as shown by Arrow A) is transverse of lid 6 and inwards of container 2. Exerting the force in this direction avoids loosening or removing lid 6. The force is transmitted by arm 34 via cap 25 to plug 11 whereupon plug 11 is disengaged and displaced from inlet skirt 10 as shown in FIG. 3 thereby opening closed inlet 9. The clearance 35 between outlet 24 and inlet skirt 10 provides a passage for the escape of air displaced from within container 2.

As shown in FIG. 4, further exertion of force on cover 21 urges chamber 23 against lid 6 whereupon a reaction from lid 6 is transmitted via disc 16 to lower dished portion 26*b* of chamber 23. The combined force and reaction causes a compression of chamber 23. Compression of chamber 23 causes a force to be transmitted by an arm 34 which disengages and displaces cap 25 from outlet 24 so creating an opening in chamber 23. Further compression of chamber 23 expels colourant 3 via inlet 9 into container 2 as indicated by arrows B.

Yet further exertion of force on cover 21 causes the annular rib 27 on cover 21 to advance towards and engage flange 15 on lid 6 with a fluid-tight snap fit, so providing a replacement closure for inlet 9 which prevents spillage from container 2 via the now otherwise open inlet 9. As rib 27 engages flange 15, upper dished portion 26*a* of chamber 23 approaches close to lower dished portion 26*b* and so expels most of the colourant 3 from chamber 23.

Finally the system may be subjected to mechanical shaking to disperse the introduced colourant 3 into paint 4. The forces which disengage and displace plug 11 and cap 25, which compress chamber 23 and which advance cover 21 into sealing engagement with flange 15 are conveniently generated by gripping capsule 1 and the base (not shown) of closed container 2 between opposed jaws of a mechanical shaker and tightening the grip.

FIG. 7 shows an alternative system in which a capsule 101 and a container 102 are modified (as compared with FIG. 1) so as to achieve better expulsion of colourant 103 from chamber 123.

Capsule 101 is modified by the presence of a circumferential bezel 121*a* around the perimeter of its circular rigid plastics cover 121. Bezel 121*a* enables cover 121 to make a close fit with upper dished portion 126*a* of the plastics foil which defines chamber 123. Container 102 is similarly modified by the presence of a bezel 106*a* on its lid 106 and around its closed inlet 109. As shown in FIG. 10, the presence of a bezel 106*a* requires a shortening (as compared with FIG. 1) of radial troughs 114 which lead to catchment cavities 118.

As shown in FIG. 8, advancing capsule 101 towards container 102 causes concave curved portion 126*d* of lower dished portion 126*b* to roll upwards and inwards of chamber 123 so exerting a force on colourant 103 which propels colourant 103 towards outlet 124.

As shown in FIG. 9, further advancement of capsule 101 sandwiches portions 126*a* and 126*b* of the plastics foil between now opposed bezels 121*a* and 106*a* so fully compressing chamber 123 and causing expulsion of virtually all of colourant 103.

Capsule 101 also employs a modified cap 125 and arm 134. The modification consists of providing a shed 134*a* which substantially reduces the amount of colourant 103 which can become trapped in top of cap 125.

Many members of the public dislike finding the arm 134 and the plug 111 immersed in the paint 104 in container 102. Accordingly FIGS. 11 and 12 show further modifications which prevent arm 134 and plug 111 from falling into paint 104.

As shown in FIG. 11, arm 134 is modified by the presence of a pair of barbs 134*b*. As shown in FIG. 11, when capsule 101 is advanced towards container 102, barbs 134*b* become obstructed by upper perimeter 124*a* of outlet 124 and therefore prevent arm 134 from falling into paint 104.

Plug 111 is modified by the presence of a central crown 111*a* provided with a circumferential rib 111*b* which can make a snap fit into circumferential groove 134*c* formed in arm 134. Advancing arm 134 onto crown 111*a* causes rib 111*b* to engage groove 134*c* so that plug 111 is held by arm 134 and is prevented from falling into paint 104.

This invention also provides a capsule comprising a (preferably compressible) chamber containing additive, preferably means for creating an opening in the chamber which opening can communicate with the inlet into the container, preferably means for expelling additive from the chamber through the opening and locating means co-operable with locating means on a closed container so as to at least assist in locating an opening created in the chamber in communication with an inlet in the container. The invention further provides for use in a system according to this invention a container comprising an inlet closed by a closure, but which inlet is openable by a force exerted on the closure in a direction inwards of the container and which container is also provided with locating means co-operable with locating means on a capsule so as to at least assist in locating the inlet in communication with an opening in a capsule containing additive.

This invention further provides a method for introducing flowable additive into a closed (preferably lidded) container which comprises:

(a) placing a capsule comprising a chamber containing additive in contact with the closed container which has an inlet closed by a closure,
(b) opening the inlet by means of a force exerted on the closure provided that if the container comprises a lid, the force exerted to open the inlet shall be insufficient to open the container by moving the lid,
(c) creating an opening in the chamber which communicates with the inlet,
(d) expelling additive through the opening into the opened inlet and thence into the container and then
(e) preferably creating a seal between the capsule and the container whereby spillage from the otherwise open inlet can be prevented.

We claim:

1. A system for introducing a flowable additive to paint, varnish, woodstain or the like contained in a closed container wherein the system comprises:

(a) a closed container containing paint, varnish, woodstain or the like, the container being provided with an inlet which is closed by an inlet closure, but which is openable by a force exerted on the inlet closure,
(b) a closed capsule separate from the closed container, which capsule comprises a chamber which defines a volume, which contains a flowable additive and which chamber can be opened to create an opening in the chamber, which opening can communicate with the inlet into said container after the inlet has been opened,
(c) means for use in positively expelling additive from the chamber through the opening by contracting the volume defined by the chamber and,
(d) co-operable locating means provided on the container and capsule which can at least assist in locating said opening created in the chamber in communication with the inlet into the container, wherein the container and the capsule are provided with one of co-operable snap fit sealing means and co-operable press fit sealing means, which can co-operate to provide a replacement closure for the container inlet so as to prevent spillage from the container after the inlet closure has been opened.

2. A system according to claim 1, wherein:
the closed container comprises a lid and the closed inlet is formed in the lid.

3. A system according to claim 1, wherein:
the sealing means comprises a rim which is dependant from the capsule, which rim extends around the opening created in the chamber and which is adapted to make a snap fit with a co-operating sealing means which extends around the inlet.

4. A system according to claim 3, wherein:
snap fitting of said snap fit sealing means is provided by a rib receivable in a groove.

5. A system according to claim 1, wherein:
the co-operable sealing means comprises a projection receivable with one of a snap fit and a press fit into a recess to provide a passageway through which flowable additive can be expelled from the capsule into the container.

6. A system according to claim 1, wherein:
the co-operable sealing means are so positioned that they only co-operate to provide the replacement closure after the inlet has been opened whereby the system allows the escape of any air displaced from the container.

7. A system according to claim 1, wherein:
the capsule comprises a chamber having at least one flexible wall and a relatively rigid member attached to a portion of the flexible wall which is to be remote from the container.

8. A system according to claim 7, wherein:
the relatively rigid member comprises a bezel extending around the member and the container has a similarly bezelled portion.

9. A system according to claim 1, wherein:
the co-operable locating means comprises:
(a) the inlet to the container comprises a recess extending into the container, which inlet leads to the inlet closure, and
(b) a projection dependant from the capsule, which projection also serves as an outlet through which said additive can be expelled from the capsule.

10. A system according to claim 9, wherein:
the inlet closure makes a snap fit with a distal end of the recess.

11. A system according to claim 9, wherein:
the projection comprises a skirt closed by a skirt-closure removable in response to a contraction of the volume which contains the flowable additive, wherein the projection is long enough to allow the outlet to penetrate far enough into the recess to enable a force exerted on the capsule to be transmitted via the projection and exerted on the inlet closure in order to open the inlet whereby the inlet closure may be opened before skirt-closure is removed.

12. A system according to claim 1, wherein:
the inlet to the container and the chamber in the capsule are both openable in response to a force exerted in a direction inwards of the container.

13. A system according to claim 12, wherein:
the volume which contains the flowable additive is contractible by means of a force exerted in a direction inwards of the container, whereby the container inlet and the capsule chamber can be opened and the volume can be contracted all by a force exerted by opposed gripping means.

14. A system according to claim 1, wherein:
a force of at least 0.05 kN is required to open the container inlet and to create the opening in the capsule chamber.

15. A system according to claim 14, wherein:
the force is from 0.4 to 1.3 kN.

16. A system according to claim 1, wherein:
the means for use in positively expelling additive from the chamber comprises a chamber which is compressible.

17. A system according to claim 16, wherein:
the compressible chamber has a shape in the form of two opposed adjacent dishes joined around respective outer perimeters thereof.

18. A system according to claim 17, wherein:
the chamber has a concave curved portion adjacent said outer perimeters.

19. A system according to claim 18, wherein:
the chamber is defined by at least one wall which has a line of weakness which extends around the chamber.

* * * * *